United States Patent [19]

Harris

[11] Patent Number: 5,046,480

[45] Date of Patent: Sep. 10, 1991

[54] COMPRESSION FURNACE

[76] Inventor: William E. Harris, 3001 S. Loop 289 C105, Lubbock, Tex. 79423

[21] Appl. No.: 535,061

[22] Filed: Jun. 8, 1990

[51] Int. Cl.[5] ..... F24C 9/00

[52] U.S. Cl. ..... 126/247; 415/207

[58] Field of Search ..... 126/247; 415/182.1, 415/199.4, 207, 208.1, 211.2

[56] References Cited

U.S. PATENT DOCUMENTS

| | | | |
|---|---|---|---|
| 2,391,838 | 12/1945 | Kleinhans et al. | 60/650 |
| 3,245,399 | 4/1966 | Lawson | 126/247 |
| 4,308,993 | 1/1982 | Buss | 237/2 A |
| 4,590,918 | 5/1986 | Kuboyama | 126/247 |

FOREIGN PATENT DOCUMENTS

| | | | |
|---|---|---|---|
| 60-57161 | 4/1985 | Japan | 126/247 |

*Primary Examiner*—Carroll B. Dority
*Attorney, Agent, or Firm*—Richard C. Litman

[57] ABSTRACT

An apparatus for the heating of air with a series of compression and expansion stages. The heating system includes four primary stages, centrifugal turbine compression, expansion through diffusing vanes, expansion into a low pressure chamber and nozzle compression. The thermal energy transferred to the air during these compression and expansion stages is of a degree to omit the need for a heat exchanger. The turbine compression stage heats and compresses the air significantly, while the following three stages convert this very high pressure and temperature air to a level that allows the air to be directly discharged into standard heating ducts. The diffusing vanes decrease the velocity of the air discharged from the compression turbine and the expansion chamber lowers the pressure to sub atmospheric pressure. The final stage compresses the air to standard atmospheric pressure and compensates for the heat lost in the expansion chamber. The air is then discharged directly into the heating ducts at a significantly higher temperature and standard atmospheric pressure.

12 Claims, 3 Drawing Sheets

N
30
30
26
E
30
20
22
30
16
T
16
14
24
20
10
30
12
30
18
S
M 52
16
26
30
N
E
M
30
30
30
34
22
58
24
54
56
32
16
31

COMPRESSION FURNACE

FIELD OF INVENTION

This invention relates generally to the heating of air and more particularly to the use of a rotary air compressor and expansion and compression nozzles to accomplish this heating.

BACKGROUND OF THE INVENTION

Improvements in heating systems for enclosed human environments such as residences and offices are highly desirable. The need for the efficient and instantaneous heating of air has long been addressed. Meat exchangers have been utilized as the most common heat transfer means. The air to be heated is circulated or passed through electrically heated coils or liquid or steam filled pipes. In these prior art systems heat is transferred from the hot coils of the heat exchanger to the air being circulated. A substantial portion of the energy put into these systems is lost due to the intermediate heating medium of the heat exchanger.

This invention is concerned with an improved heat generating apparatus wherein the working medium, air, is subjected to alternate compression and expansion stages. A heat exchanger is not required in the system of the present invention due to the fact that all work done on the air is accomplished by the turbine blades and compression and expansion nozzles. It follows that any system that will directly heat air without the need for a heat exchanger, and without substantial power requirements will present a unique advancement of the art.

DESCRIPTION OF THE RELATED ART

The broad concept of air heating systems using compressors, turbines and nozzles are generally known. Some specific examples of systems of this type are found in aviation environments. U.S. Pat. No. 2,391,838 issued to Earl S. Kleinhans and Wilbur W. Reaser discloses a system of this kind. In this patent high altitude air at low pressure and low temperature is drawn into an air compressor. This compressor is driven by the aircraft engine through the drive shaft of the propeller. As the air leaves the compressor it is at high pressure and very high temperature. Often the air is at such a high temperature that it must be cooled before it can be discharged to the heated environment. To decrease the air temperature it is directed through a cooling heat exchanger and through an energy absorbing turbine. The resulting cooled air is discharged directly into the aircraft cabin or mixed with an appropriate amount of very high temperature air directly discharged from the air compressor.

Another heating system used to heat aircraft cabins is disclosed in U.S. Pat. No. 4,308,993 issued to Linus B. Buss. This system uses hot compressed air bled from the compressor section of the turbine engine of the aircraft. The hot compressed air is circulated through a heat exchange to transfer heat to cabin air. The heated cabin air is then directed back to the passenger environment. This system also uses a heat exchanger as the primary heat transfer means. In neither of the above systems is the apparatus for the compression of air dedicated specifically for heating air; rather, these systems have the primary function of powering an aircraft, with the heated air simply a by-product.

With the above described systems it is inherent that energy will be lost between the production of the heated compressed air and the air discharged into the environment to be heated. Energy or heat is lost through the pipes leading to the heat exchanger, and energy is absorbed by the materials that comprise the heat exchanger itself. The hot compressed air, upon exiting the heat exchanger is warm if not still very hot. This indicates that all the possible energy in the hot compressed air was not transferred to the cabin air. Additionally, the heating systems described above use aircraft engines as the drive means for the air compressor. A power source of this kind would not be appropriate in residential or office buildings.

None of the above listed patents are seen to disclose the specific arrangement of concepts disclosed by the present invention.

SUMMARY OF THE INVENTION

By the present invention, an improved system for directly and instantaneously heating air, which will also serve as the air delivery means, replacing the blower in a residental heating system for example, is disclosed to eliminate the drawbacks in the prior art. The system of the present invention is comprised of four main components, rotary compressor turbine, diffusing vanes, expansion chamber and secondary compression nozzle. The rotary compressor turbine performs as the air intake, and as the first stage in air pressure and temperature increase. The rotary compressor turbine (or compression turbine) is driven by a one to two horsepower electric motor operating at a high torque level of between 3000 to 5000 revolutions per minute. The rotary compressor turbine is of such a design that a low pressure situation, approximately 14.5 psig, is created at the turbine input. As air passes through the blades of the turbine it is compressed, increased in velocity and increased in temperature. At the exit of the compressor turbine the air is at significantly higher levels of pressure and temperature.

The second stage is the diffusing vane portion. The diffusing vanes are a series of radially and tangentially angled blades spaced downstream of the compression turbine discharge. As air leaves the compression turbine it enters the input of the diffuser vane section. The blades of the diffusing vanes are angled in such a way that the input cross sectional area is less than the output cross sectional area. This results in an expansion of the compressed, high temperature air discharged from the compression turbine. The diffusing section acts to decrease the velocity, increase the static pressure, and further increase the temperature of the heated air.

The next stage in the heating system of the present invention is the expansion chamber. The expansion chamber acts to further reduce the velocity and reduce the static pressure of the processed air. The diffusing vanes are adjustable so as to be optimumly positioned for maximum heating. Immediately following the expansion chamber the fourth and final stage of the heating system is encountered. This final stage is the compression nozzle and this nozzle acts to compress and heat the low velocity, low pressure air to normal atmospheric pressure. The temperature of the air exiting the compression nozzle is significantly higher than ambient air at the intake of the compression turbine. The temperature increase is on the order of three or four to one for air exiting the system at the compression nozzle and air entering the system at the input of the compression turbine.

Accordingly, one of the objects of the present invention is to provide an improved, energy efficient and instantaneous air heating system for residential or office environments utilizing a rotary compressor turbine.

Another object of the present invention is to provide an improved air heating system with multiple compression and expansion stages to thermodynamically heat processed air.

A still further object of the present invention is to provide an improved air heating system with low power requirements and manufactured from inexpensive materials.

Yet another object of the present invention is to provide an air heating system which will also serve as the air delivery means, replacing the blower in a residential heating system for example, that will require no major changes to existing duct work in residential or business housing.

A further object of the invention is to provide an air heating system employing a rotary air compressor which will deliver heated air at an acceptable pressure and velocity to an enclosed human environment.

With these and other objects in view which will more readily appear as the nature of the invention is better understood, the invention consists in the novel combination and assembly of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
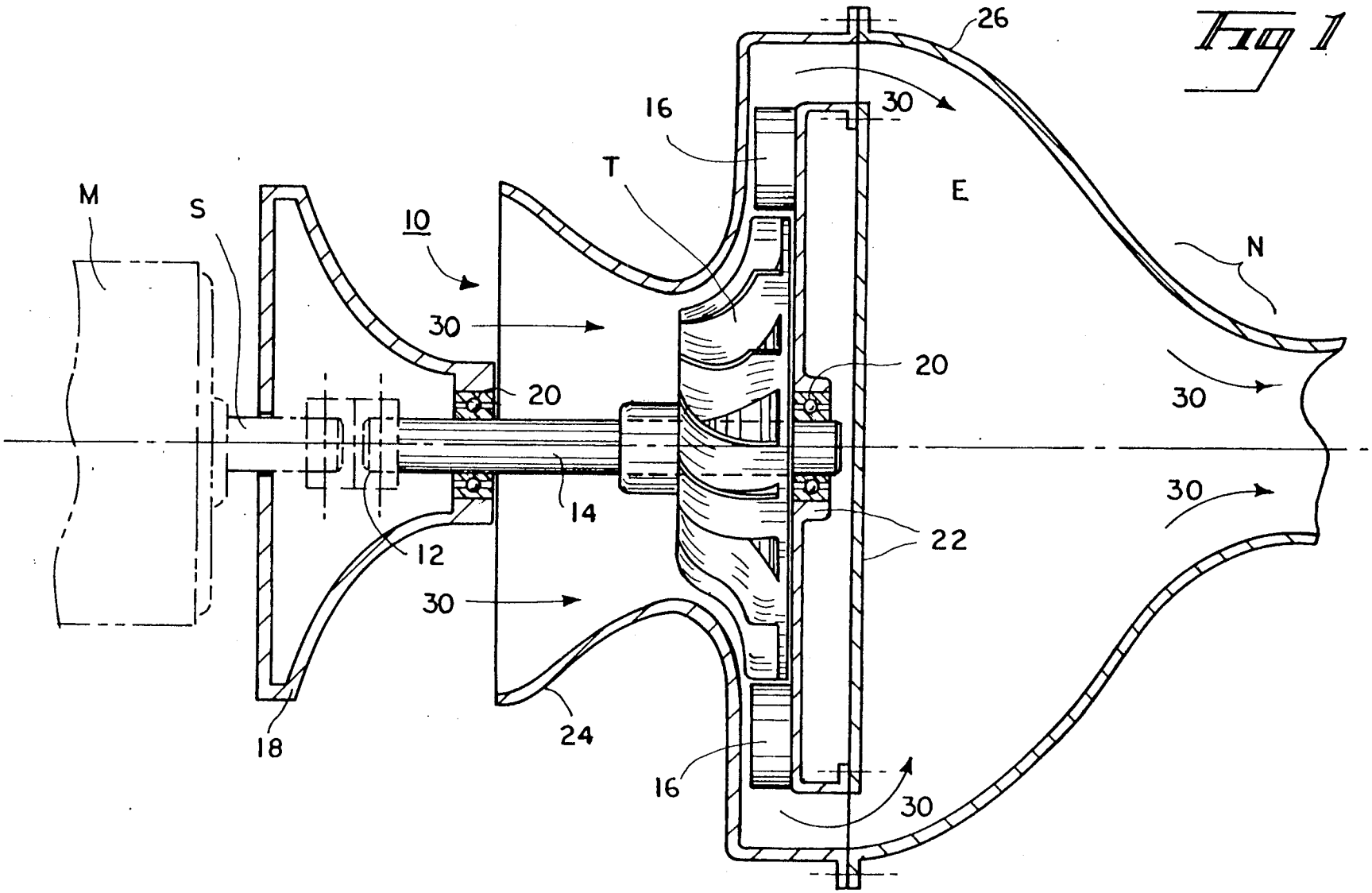
FIG. 1 is a top view, with part of the external housing removed to show the internal components, of the air heating system of the present invention.

Referring now to the drawings, particularly FIG. 1, the present invention will be understood to relate to an air heating apparatus including an electrical motor, rotary compression turbine, diffusing vane assembly, expansion chamber and compression nozzle. Electric motor M via drive shaft S powers the rotary compressor turbine T of the first embodiment of the invention which is a radial flow turbine. Motor M drives turbine T in the counterclockwise direction and in so doing draws air in from Venturi air intake 10. As the turbine T rotates counterclockwise the air is forced along the turbine blades and compressed.

Figure 2:
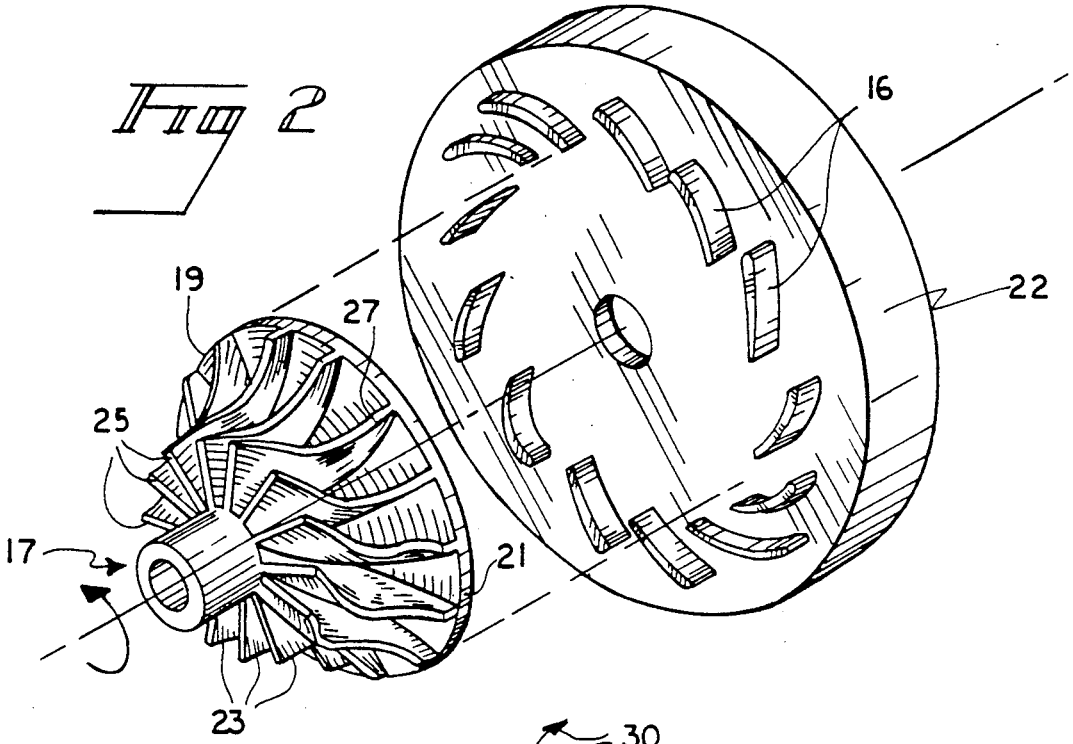
FIG. 2 is an exploded perspective view of the rotary compression turbine and the diffusing vanes, the diffusing vanes being shown attached to the diffusing vane housing assembly of the first embodiment of the invention showing a radial flow turbine.

In FIG. 2 is shown the radial flow turbine in greater detail. The central hub 17 is an elongate cylindrical member which receives drive shaft S, shown in FIG. 1, therethrough. Central hub 17 is mounted perpendicular to the center of circular end plate 19 having a periphery 21. Rotating blades 23 are mounted radially on central hub 17 and have leading edges 25 and trailing edges 27. The leading edges 23 are radially perpendicular to the central hub 17 and the trailing edges are perpendicular to end plate 19 adjacent to the end plate periphery 21. To provide compression, the trailing edges must be of greater height than the leading edges. The rotating blades 23 define curved surfaces angled to impart angular velocity to the flowing air. Air is drawn into the rotating blades 23 adjacent to the leading edges 25, and is forced between the blades in airflow path 30 and exhausted adjacent to the trailing edges 27. This compression increases the pressure, temperature and velocity of the air. As the air is compressed its temperature increases due to increased molecular activity.

The turbine T is driven by shaft S. Shaft S is mounted through hub 17, as shown in FIG. 2, to which it is fixedly attached so that rotation of shaft S causes rotation of the rotary compressor turbine T, and rotatably mounted at the center of stationary diffuser plate 22. Returning to FIG. 1, shaft S is sectioned via coupling 12 and shaft 14. The need for second shaft 14 and coupling 12 arises for the protection of motor M. If an obstruction entered the air intake and lodged in the turbine T, the turbine could jam and abruptly cease rotation. This would destroy the electric motor M. The coupling prevents an occurrence of this nature from causing serious damage. If the turbine abruptly ceased rotation coupling 12 would become overly stressed and tear apart. Motor M would sense a decrease in the load on shaft S and, responding to this situation, turn itself off. The coupling would be easily replaced after removal of the obstruction. The specific coupling device employed need not be described further, as devices of this type are well known in the art.

Housing 18, shown in a cut away view in FIG. 1 encloses part of shaft S, coupling 12, part of shaft 14 and bearings 20. Bearings 20 can be of the standard ball bearing type or needle bearings or any equivalent bearing type. Bearings 20 support shaft 14 at the forward portion of housing 18 and at the rearward portion of housing 22. Mousing 24 encloses part of shaft 14, compression turbine T and diffusing vanes 16. The housings 18, 22, 24 and 26 can be constructed of any heat resistant metal alloy. A screen or air filter is present, although not shown in the drawings, between housings 18 and 24. This is to prevent debris or foreign matter from entering air intake 10 and interfering with compression turbine T. Housing 24, and housing 26 define the airflow path, designated 30 in all drawing figures, through the apparatus of the invention. Housing 24 is shaped to closely enclose rotating blades 23, shown in FIG. 2, and, therefore, define the airflow path through the radial flow turbine, the flow path through the diffuser section 22, explained in detail below, and, returning to FIG. 1, to form the passage from the output of the diffusing vanes 16 to the entrance of the expansion chamber E. The term "downstream" is used throughout this application to indicate the same as the direction of the airflow path 30. The term "upstream" indicates the opposite. Expansion chamber E consists of the enclosed space formed by housing 26. The volume of the expansion chamber is greatest where housing 26 meets with housings and 24. The walls of housing 26 gradually converge and begin to form the secondary compression nozzle N. From a viewpoint outside the housings, the expansion chamber would consist of the convex portion of housing 26, while the secondary compression nozzle would be comprised of the concave portion of housing 26.

Turbine T is rotated at a rate of approximately 3000 to 5000 revolutions per minute. This rate will induce a low pressure situation at the input of the turbine and draw in a high volume of ambient air. A typical value for the pressure at the turbine inlet is 14.5 psig compared to 14.7 psig standard atmospheric pressure.

Figure 3:
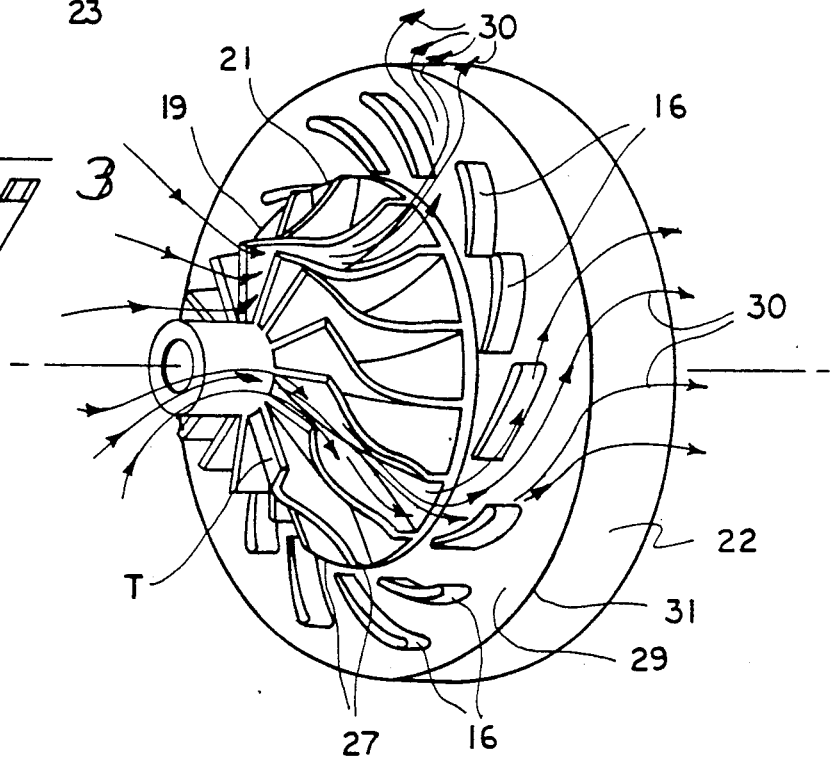
FIGS. 3 shows air flow through the rotary compression turbine, and diffusing vanes.
Figure 4:
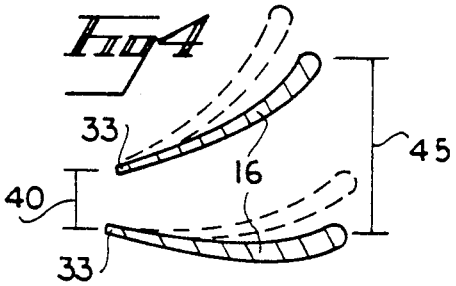
FIG. 4 shows adjustable diffusing vanes.

The next phase in the heating system of the present invention occurs at the diffusing vanes 16. High pressure and high temperature air exiting the output of the turbine T will enter the diffusing vanes 16, as shown in FIG. 3. In this figure air flow is shown by the curved lines 30. The air is at a very high velocity and to be directly discharged to a heated environment the velocity must be decreased. The diffusing vanes are arcuate members mounted perpendicularly to diffuser plate 22 and outside of rotating blades trailing edges 27. Diffuser plates 22 is mounted downstream of the turbine T, and the diffuser vanes must be of height sufficient to extend to approximately the same plane as the height of trailing edges 27. The cross sectional area at the input of the diffusing vanes must be less than the area at the output of the diffusing vanes. This is dictated by the fact that the circumference of the airflow path at the peripheral edge 21 of radial flow turbine end plate 19 is less than the circumference at the output of diffusing vanes 16 adjacent to the peripheral edge 31 of diffuser plate 22. This difference in circumference, regardless of the diffuser vanes 16, contributes to the expansion of the air. As the air is expanded the velocity decreases significantly. FIG. 4 shows a cross sectional view of two adjacent diffusing vanes. As can be seen from this figure the inlet dimension 40 is smaller than the output dimension 45.

An additional feature of the diffusing vanes is their adjustability. The diffuser vanes 16 are pivotally mounted at 33, the securable pivot shown in FIG. 4, to the inner surface 29 of diffuser plate 22. At the time of manufacture or installation, depending on the intended use and environment of the heating system, the diffusing vanes can be rotated tangentially to adjust for optimum angular deflection in the airflow path on exiting the turbine T. Increased angular deflection will reduce the angular velocity of the air, increase static pressure and increase temperature. If low volume requirements are expected, pertaining to a low volume air heating requirement, in the case of a small room or house to be heated, the air flow through the turbine T will be decreased. With a slower rotational speed of the turbine the velocity of the air at the exit of the turbine will also be decreased. Therefore, according to a lower air velocity, the diffusing vanes can be adjusted for minimal angular deflection. If medium volume requirements are expected, pertaining to a medium volume air heating requirement, in the case of a large room or medium sized house the diffusing vanes can be adjusted to increase angular deflection.

If a large volume of air is expected to be heated, pertaining to a high volume air heating requirement, as in the case of a large house or a non-residential building, the diffusing vanes can be adjusted for maximum angular deflection. The larger heating requirement demands an increased rotational speed of the turbine, resulting in a higher velocity for the air at the output of the turbine. This high velocity air must be decelerated to a greater degree, and therefore requires a larger angular deflection provided by the diffusing vanes.

Upon exiting the diffusing vanes the hot air is still at a substantial pressure. To further decrease the pressure the air is discharged into an expansion chamber. The chamber is designated by the letter E in FIG. 1. The expansion chamber decreases the air pressure to below standard atmospheric pressure and it also functions as the exit of the heated air into the heating system duct work. The final stage of the heating system is the compression nozzle N. This nozzle functions to compress the air to standard atmospheric pressure of 14.7 psig and further heat the air. The expansion chamber converts the high pressure, high temperature air to low pressure air still at an elevated temperature. The compression nozzle raises the air velocity to a level necessary for discharge into standard heating ductwork and adds additional thermal energy to the air. The result is high temperature air at a low velocity and standard atmospheric pressure being discharged from the heating system. The increase of air temperature between the inlet of the compression turbine and the output of the compression nozzle is on the order of 3:1 for an inlet temperature of 60 degrees Fahrenheit and an outlet temperature of approximately 200 degrees Fahrenheit.

Figure 5:
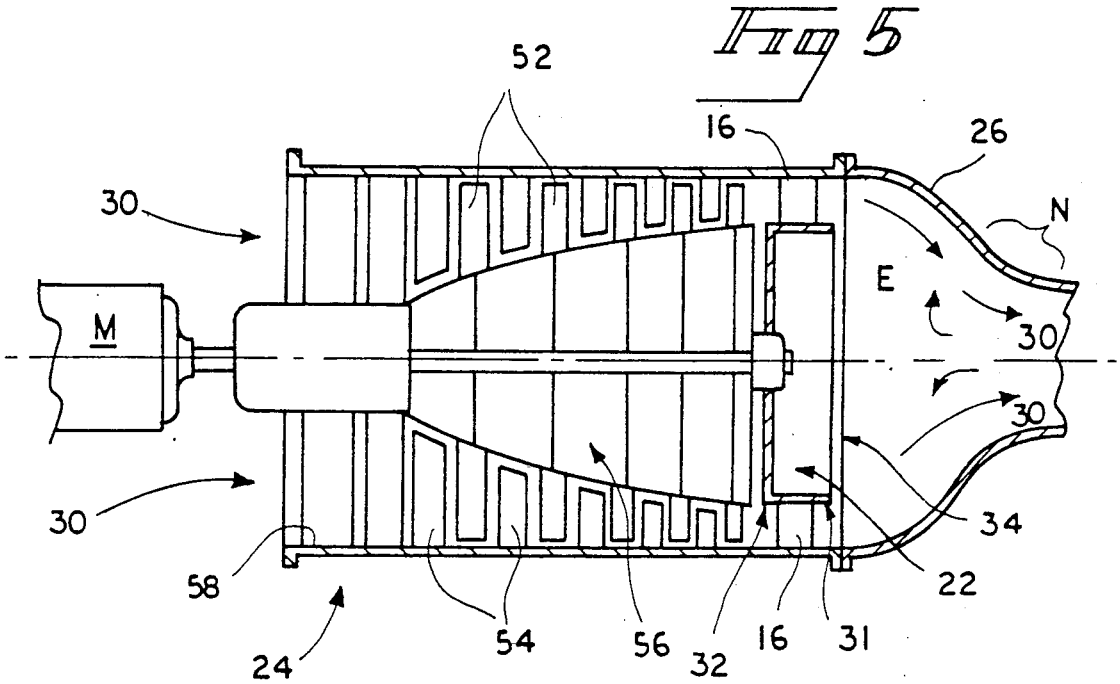
FIG. 5 is a cross sectional view of the second embodiment of the present invention showing the use of an axial compressor, turbine for the compression means.

The second embodiment of the present invention using an axial flow turbine of known design is shown in FIG. 5. Rotating blades 52 are mounted on the central rotating body 56. The central rotating body 56 is a frusto-conical member with increasing cross-sectional area in the direction of the airflow path. The housing 24 in this embodiment is a cylindrical enclosure. The rotating blades 52 are appropriately curved and angled members mounted in a circular array on the rotating body 56 at successive perpendicular cross-sections of the turbine extending in length to a location adjacent to the housing 24 inner surface 58. The rotating blades 52 are mounted in parallel along the length of the rotating inner body 56 and alternate with stationary or stator blades 54.

The stator blades 54 are mounted on the housing 24 inner surface 58 and extend to a location adjacent to the rotating inner body 56.

The diffuser plate 22 in this embodiment of the invention is mounted downstream of the axial flow turbine. The diffusing vanes 16 are mounted on and radially extending from the periphery 31 of the diffuser plate 22. The pivot point 33, as shown in FIG. 4, in this embodiment of the invention is located on the periphery 31 of diffuser plate 22 and the diffuser vanes extend angularly, adjustable as described above and shown in FIG. 4. The height of the diffuser vanes 16 in this embodiment of the invention, as can be seen, is approximately equal to the height of the last set of rotating blades 52, taken in the direction of the airflow path, mounted on the rotating body 56 of the axial flow turbine. Diffusing vanes 16 are displaced in a circular array around the output of the axial turbine. The expansion chamber E and nozzle N are of the same construction as in the centrifugal turbine case. Both being formed by the outer housing 26. Airflow 30 through the system is designated by the arrows shown in the drawing.

It can be seen that the heating system of the present invention successfully has omitted the need for a heat exchanger, and by so doing has increased the response time to discharge heat into a given environment. The power requirements for the electric motor are substantially less than the drive mechanisms used to power the compressors in the prior art patents cited earlier, since the invention is designed specifically to deliver heated air to an enclosed human environment, which was merely a by-product of prior art systems.

It is to be understood that the present invention is not limited to the sole embodiment described above, but encompasses any and all embodiments within the scope of the following claims.

I claim:

1. An apparatus for the heating and delivery of air to an enclosed human environment comprising:

a housing having ambient air inlet and heated air outlet means and said housing defining a continuous unidirectional airflow path, rotary compression means occupying a limited interior portion of said housing and disposed downstream of said housing inlet to compress, impart angular velocity, and raise the temperature of the air;

diffuser means occupying a limited interior portion of said housing and disposed downstream of said rotary compression means said diffuser means having arcuate diffuser vanes disposed transverse to the airflow path and extending at a selected angle to the airflow path whereby said diffusing vanes are adapted to remove angular velocity from the air and to increase static pressure, and an expansion chamber occupying a limited interior portion of said housing and disposed downstream of said diffuser means and communicating with said heated air outlet means and having air volume increasing means to thereby decrease the pressure of the air discharged from said diffuser means, and wherein the housing heated air outlet means has compression means to further raise the delivery temperature of the air by the heat of compression.

2. The apparatus of claim 1 wherein the heated air outlet compression means further comprises an extended circular airflow passage of decreasing cross-sectional area.

3. The apparatus according to claim 1 wherein the rotary compression means further comprises drive means disposed exterior to said housing and having communicating means therethrough with said rotary compression means whereby said drive means causes rotation of said rotary compression means.

4. The apparatus according to claim 3 wherein the communicating means further comprises an elongate cylindrical shaft having a first section rotatably connected to the drive means and a second section fixedly connected to the rotary compression means to rotate said rotary compression means, said first and second sections connected by a flexible coupling whereby the flexible coupling will disengage said first shaft section from said second shaft section when said second section exerts a predetermined torsional resistance.

5. The apparatus according to claim 1 including means pivotably mounting said diffuser vanes wherein said arcuate diffuser vanes are angularly adjustable relative to the airflow path whereby the angular velocity and static pressure of the air exiting the diffuser may be varied.

6. The apparatus according to claim 1 wherein said rotary compression means further comprises a radial flow turbine having a cylindrical central hub perpendicularly mounted to a circular end plate and having radially mounted rotating vanes with leading edges perpendicular to said central hub and with trailing edges perpendicular to said end plate and juxtaposed to said end plate periphery, and whereby air is delivered by suction contiguous to said leading edges and exhausted contiguous to said trailing edges whereby the air undergoes compression and temperature increase, and angular velocity is imparted to the air.

7. The apparatus according to claim 6 wherein said rotating vanes leading edges are of lesser height than said trailing edges.

8. The apparatus according to claim 7 wherein said diffuser means further comprises a circular diffuser plate fixedly mounted downstream and parallel to said radial flow turbine end plate having an upstream surface and having arcuate diffuser vanes annually spaced and perpendicularly mounted to said diffuser plate upstream surface whereby said rotating vane trailing edges are disposed inwardly of the diffuser vanes and have a height approximately equal to an inner circumference of said annually spaced diffuser vanes.

9. The apparatus according to claim 8 including means wherein said arcuate diffuser vanes are angularly adjustable relative to the airflow path whereby the angular velocity and static pressure of the air exiting the diffuser may be varied.

10. The apparatus according to claim 1 wherein said rotary compression means further comprises an axial flow turbine having air intake and air exhaust means said axial flow turbine disposed within a cylindrical housing and having a central rotating body of increasing cross-sectional area with perpendicularly extending curved and angled rotating vanes and said cylindrical housing having an inner surface with curved and angled stationary vanes disposed inwardly and in an alternating arrangement with said rotating vanes, whereby air is induced to flow in the direction of increasing central body cross-sectional area in a path defined by said rotating and stationary vanes.

11. The apparatus according to claim 10 wherein said diffuser means further comprises a circular diffuser plate mounted upstream and in parallel to said central rotating body cross section having a diameter approximately equal to the greatest cross-sectional diameter of said central rotating body and having arcuate diffuser vanes mounted in equidistant relationship perpendicularly on its outer periphery and said diffuser vanes having a height extending beyond said diffuser plate outer periphery approximately equal to the height of said axial flow turbine rotating vanes located at the greatest cross-sectional diameter of the central rotating body.

12. The apparatus according to claim 11 including means wherein said arcuate diffuser vanes are angularly adjustable relative to the airflow path whereby the angular velocity and static pressure of the air exiting the diffuser may be varied.

* * * * *